United States Patent [19]

Kurisu et al.

[11] Patent Number: 4,878,462

[45] Date of Patent: Nov. 7, 1989

[54] ENGINE VALVE OPERATING APPARATUS

[75] Inventors: Toru Kurisu, Hiroshima; Tuneo Kodama, Higashihiroshima, both of Japan

[73] Assignee: Mazda Motor Corporation, Hiroshima, Japan

[21] Appl. No.: 151,667

[22] Filed: Feb. 2, 1988

[30] Foreign Application Priority Data

Feb. 5, 1987 [JP] Japan ..... 62-26070

[51] Int. Cl.[4] ..... F01L 1/08

[52] U.S. Cl. ..... 123/90.17; 123/90.6

[58] Field of Search ..... 123/90.6, 146.5 A, 90.31, 123/90.17

[56] References Cited

U.S. PATENT DOCUMENTS

| | | | |
|---|---|---|---|
| 2,567,690 | 9/1951 | Bishop et al. | 123/90.6 |
| 2,628,605 | 2/1953 | Jones et al. | 123/90.6 |
| 2,647,500 | 8/1953 | Lang | 123/90.6 |
| 2,804,863 | 9/1957 | Bensinger et al. | 123/90.6 |
| 4,538,559 | 9/1985 | Imamura et al. | 123/90.6 |
| 4,553,510 | 11/1985 | Yano et al. | 123/90.34 |

FOREIGN PATENT DOCUMENTS

| | | | |
|---|---|---|---|
| 58-51204 | 3/1983 | Japan . | |
| 0201905 | 11/1984 | Japan | 123/90.6 |

*Primary Examiner*—Charles J. Myhre
*Assistant Examiner*—Weilun Lo
*Attorney, Agent, or Firm*—Fleit, Jacobson, Cohn, Price, Holman & Stern

[57] ABSTRACT

An engine valve operating apparatus of the type having an overhead camshaft with a plurality of cams for opening and closing intake and exhaust valves of an internal combustion engine. The camshaft is mounted on the engine by means of a plurality of bearing members each disposed one between two adjacent cams. The outermost cam is disposed outside the outermost bearing member and has a cam lobe with a closing ramp height higher than that of the cam lobes of the remaining cams.

19 Claims, 6 Drawing Sheets

ENGINE VALVE OPERATING APPARATUS

BACKGROUND OF THE INVENTION

The present invention relates to a valve operating apparatus for an internal combustion engine and more particularly, but not exclusively, to a valve operating apparatus for an internal combustion engine equipped with an overhead camshaft.

As is well known in the art, camshafts have cam lobes integrally formed as a part thereof for opening and closing intake and exhaust valves, each cam lobe comprising a cam nose section by which a topmost point of valve travel is defined; opening and closing flank sections for lifting a member, for example a tappet, a rocker arm or the like, of a valve train so as to open and close the valve; and ramp sections which connect the opening and closing flank sections to a base section of the cam having a substantially semi-circular periphery coaxial with the camshaft. A ramp height of the cam lobe, which is defined by the difference between the radial distance of a juncture of the ramp and flank sections from the center of the camshaft and the radius of a base circle of the base section, is provided for the reason that a smaller clearance is needed between the base section of the cam and the member of the valve train associated with the cam not only because if the member of the valve train always rides on the base section of the cam, the valve is possibly disabled to close from the result of a thermal expansion of the valve train during engine operation but also because that the cam is needed to lift the valve excessively in order to cancel a deflection of the valve train, in particular a valve stem, which is caused before the valve actually opens after the member of the valve train has been brought into contact with the flank section of the cam lobe. Furthermore, if there is not provided a ramp section, it will be hard to connect the flank section to the base with continuity or without uneveness; objectionable noises and vibrations will occur when the member of the valve train rides on or over the flank section of the cam lobe.

Therefore, for a smooth and quiet operation of the engine, a proper lamp height has to be provided in every cam lobe. It the cam has a cam lobe with an improper ramp height, it develops a serious problem such as a bouncing. Specifically, when the valve moves down from its topmost to its lowermost point of travel, in particular immediately before a valve head of the valve is closed tightly against its valve seat, the valve reduces rapidly its speed of movement, resulting in a resilient deflection of the valve train, in particular of the valve stem thereof. As long as the cam lobe of the cam has a ramp height properly designed, even though a practical valve lift becomes smaller than a designed valve lift due to the resilient deflection of the valve train, the cam substantially cancels the deflection. As a result, the valve head can be seated in the valve seat more gently and quietly.

On the other hand, if the cam has a cam lobe with an improper or smaller ramp height, it is impossible to cancel the resilient deflection of the valve train. This develops a problem that the valve head impulsively clashes against the valve seat and, therefore, bounds to re-open immediately after closing. This re-opening of valve is well known in the art as a bouncing. If in fact such a bouncing occurs on the valve, the valve train, in particular the valve stem, receives an undesirable, excessively strong impulsive force and, thereby, is sometimes damaged or confuses an intake and exhaust operation of the engine. Because bouncing occurs depending on the impulsive force which increases as an increase of engine r.p.m., the impulsive force is one of the factors which govern a practical maximum engine r.p.m.

Meanwhile, in overhead valve engines, for example inline four cylinder overhead camshaft engines of the type having a camshaft with a plurality of operating cams, four every cylinder, the camshaft is mounted for rotation on the engine by a plurality of journal bearings. The camshaft, in particular for intake valves, is provided at one end with a timing sprocket or timing gear driven by a toothed drive belt and is coupled at the opposite end to a distributor. One such camshaft is disclosed in Japanese Patent Unexamined Publication entitled "Valve Operating Apparatus Used In A Multi-Cylinder Internal Combustion Engines", laid open Mar. 25, 1983.

The intake camshaft thus constructed has outermost cams which are oppositely located outside the outermost journal bearings, respectively. In other words, each outermost cam is supported in the form of a cantilever by and overhangs the outermost journal bearing. Due to this cantilever supported outermost cam, the opposite end portions of the camshaft extending outside the outermost journal bearings tend to become weaker in rigidity more than the rest portion of the intake camshaft. In more detail, the end portion with timing gear attached thereto is not so weak in comparison with the other opposite end portion with the distributor coupled thereto because it will receive a force from the tensioned drive belt. For this construction of the camshaft, the end portion of the intake camshaft coupled to the distributor is apt resiliently to deflect.

Owing to such a deflection of the member of the valve train and the intake camshaft itself, the outermost valve in association with the outermost cam generally becomes short in travel or valve lift more than its intended or designed valve lift. This means that the cam lobe of the outermost cam actually has an improper, namely smaller, ramp height and makes the outermost valve cause a bouncing due to an excessive impulsive force exerted on the valve seat. Therefore, the increased impulsive force against the valve seat induces a bouncing of valve at a lower engine r.p.m., thereby reducing the practical maximum engine r.p.m. of the engine. Usually, in overhead valve engines, the practical maximum engine r.p.m. thereof is governed by a critical implusive force inducing an undesired bouncing on the valve operated by the outermost cam which is produced at a engine r.p.m. lower or less than engine speeds at which an undesired bouncing is induced on the valves operating the remaining cams.

As apparent from the above description, the conventional valve operating apparatus having a camshaft which has a plurality of cams formed with a same cam lobe of which the outermost cam is located outside the outermost journal bearing limit practical engine speed and is harder to operate with a high efficiency.

OBJECT OF THE INVENTION

It is, therefore, an object of the present invention to provide a valve operating apparatus which can attain an increased practical engine r.p.m. and which will allow the engine to operate with a high efficiency.

SUMMARY OF THE INVENTION

The above and other objects are accomplished by providing a valve operating apparatus comprising an overhead camshaft mounted on a cylinder head by a plurality of journal bearings for rotation; and a plurality of cams arranged coaxially and axially separated from one another each of which consists of a cam nose section, opening and closing flank sections continuously formed on opposite sides of the cam nose section, and ramp sections smoothly connecting the opening and closing flank sections to a base section of the cam, respectively; the axially outermost cam, which is placed in postion outside the axially outermost journal bearing, being provided with at least the lamp section connecting the closing flank section having a ramp height taller than that of the lamp section of any one of the remaining cams. According to the valve operating apparatus of the present invention, although the outermost cam is provided on an cantilever shaped end portion of the camshaft which is the weakest part on the camshaft in the aspect of rigidity and, thereby, tends to deflect, a valve seat in association with the valve operated by the outermost cam receives a greatly reduced impulsive force. As a result, the engine r.p.m. is increased at which the valve seat in association with the valve operated by the outermost cam receives the critical impulsive force and, thereby a bouncing of the valve occurs so that the practical maximum engine r.p.m. attainable is increasingly improved.

BRIEF DESCRIPTION OF THE DRAWINGS

The above and other objects and features of the present invention will become apparent from the following detailed description taken in conjunction with the preferred embodiments thereof with reference to the accompanying drawings in which like parts are designated by like reference numerals throughout the several views of the drawings and wherein:

FIG. 5 (B) is a diagram showing a valve lift curve of the outermost cam of FIG. 4;

DETAILED DESCRIPTION OF PREFERRED EMBODIMENTS OF THE INVENTION

Because internal combustion engines are well known in the art, the present description will be directed in particular to elements forming part of, or cooperating directly with, apparatus in accordance with the present invention. It is to be understood that elements not specifically shown or described can take various forms well known to those skilled in the internal combustion engine art.

Figure 1:
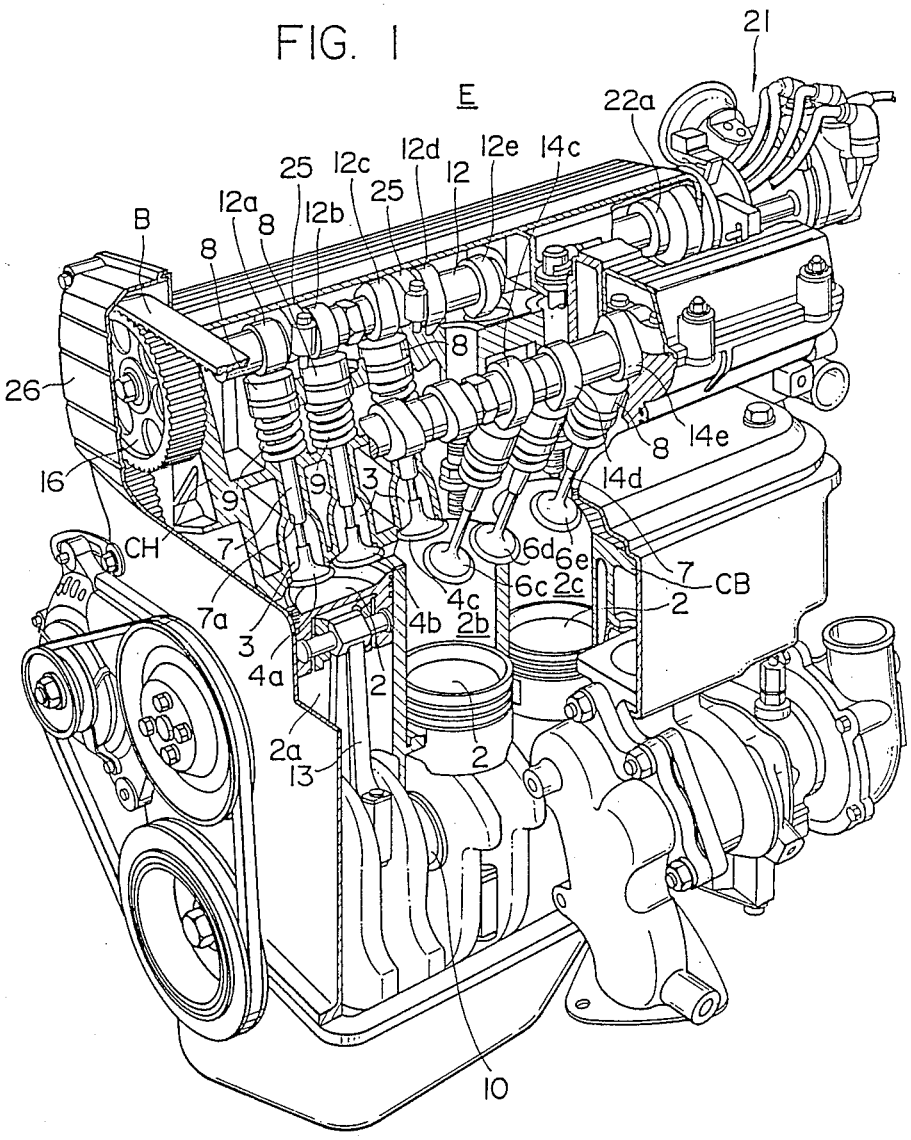
FIG. 1 is a partially cutaway view in perspective of an internal combustion engine which embodies the present invention.
Figure 2:
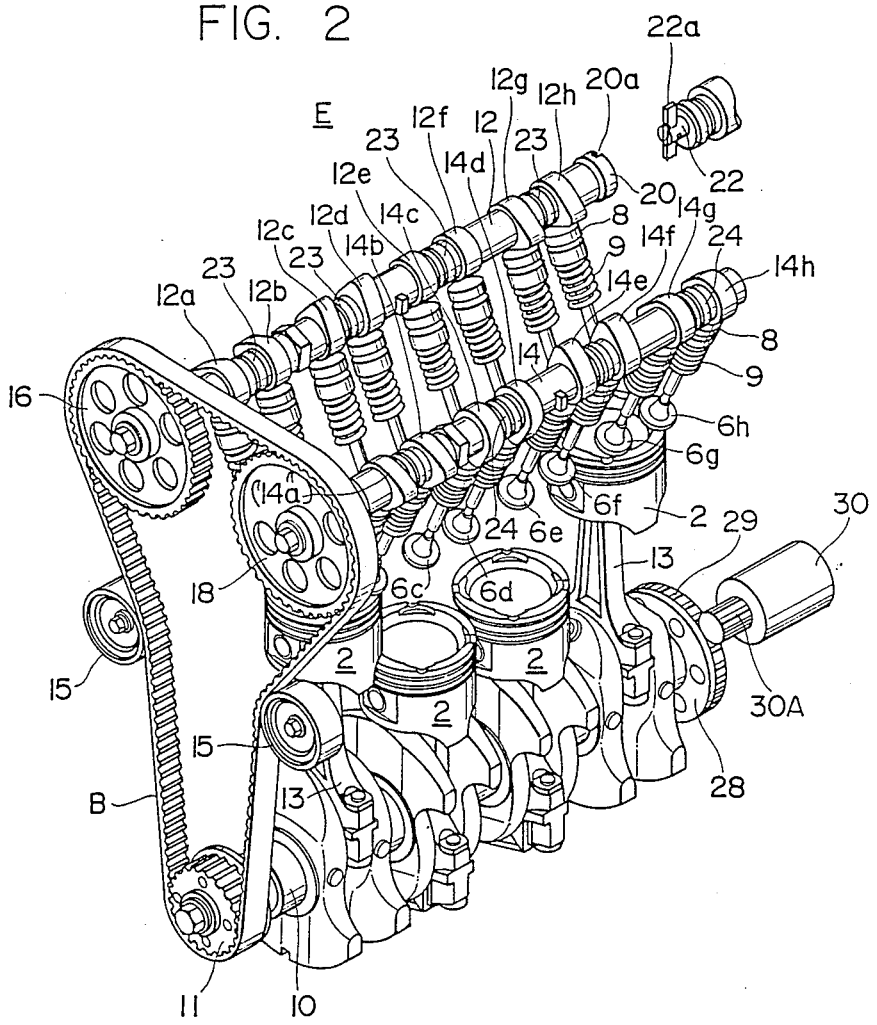
FIG. 2 is a perspective view of a preferred embodiment of the valve operating apparatus according to the present invention.

Referring now to FIGS. 1 to 2, shown therein is an in-line four cylinder overhead valve engine E for a vehicle wherein cylinder block CB, crankcase and cylinder head CH are partly or fully removed for clear illustration. As is well known in the art, the cylinder block CB has a plurality of, for example in thsi embodiment first to fourth from the front, cylinders 2*a* to 2*d*. Into each cylinder a snug fitting piston 2 is placed. The cylinder head CH, which is fastened to the cylinder block CB in place with bolts or studs and nuts to form a combustion chamber for each cylinder, is formed with valve ports 3 four each cylinder, more specifically two for intake and two for exhaust. For opening and closing the respective valve ports 3, intake valves 4*a* to 4*h* and exhaust valves 6*a* to 6*h* are provided one individual to each port 3. Each valve has its valve stem 7 which slides up and down in a hole 7*a* bored in the cylinder head CH. Attached to the valve stem 7 at its upper end is a cam follower or valve end member 8 such as a tappet. Between the valve end member 8 and the cylinder head CH there is a valve spring 9 which forces the valve upwardly to close its associated valve port 3.

The engine E mounts in the crankcase a crankcase 10 for rotation to which the pistons 2 are connected by means of connecting rod assemblies 13 for up and down monement. Because elements associated with the pistons 2 and the crankshaft 10 are well known in construction and function to those skilled in the art, no description is needed. The crankshaft 10 has one end which extends outside the crank case and is attached with a drive sprocket or timing gear 11 (see FIG. 2).

Overhead the cylinders 2*a* to 2*d* the engine mounts two belt driven overhead camshafts 12 and 14 with cams machined as parts of the camshafts 12 and 14 for the intake valves 4*a* to 4*h* and the exhaust valves 6*a* to 6*h*, respectively. Each camshaft 12, 14 is kept in place in a well known manner, for example by using a thrust washer behind a timing gear 16, 18 bolted to the cylinder head CH. As is clearly shown in FIG. 2, each camshaft 12, 14 has its front end portion which extends outside the cylinder head CH and is attached with the timing sprocket or timing gear 16, 18 secured thereto. Stretched between these timing gears 11, 16 and 18 is a toothed timing belt B by which the intake and exhaust camshafts 12 and 14 are turned at one-half crankshaft speed. For preventing the entrance of dirt and dust and eliminating the loss of oil, the timing gears 11, 16 and 18 are covered by a timing gear cover 26. Tension roller 15 applies proper tension to the timing belt B. As is well known in the art, at the beginning of operation of the engine E, the crankshaft 10 is turned by the aid of a starter well known per se. The starter includes a starter motor 30 having a geared shaft 30A in mesh with a ring gear 29 which may be firmly secured to or machined as a part of a flywheel 28 connected to the crankshaft 10.

On each camshaft 12, 14 there are a plurality of cams 11*a* through 12*h*, 14*a* through 14*h*, one respective to each valve 4, 6. Although the cams are generally designed to have a same cam lobe, nevertheless, as will be described in detail later, only the outermost cam 12*h* has a cam lobe different from those of all the remaining cams, which is a most important feature of the present invention. The intake camshaft 12 has its rear connecting end 20 overhanging the fourth cylinder 2*d* and the cylinder head CH. This connecting end 20 of the intake camshaft 12 is formed with a joint groove 20*a* which receives a joint plate 22*a* pivoted to a drive shaft 22 of a distributor 21 well known per se.

Figure 3:
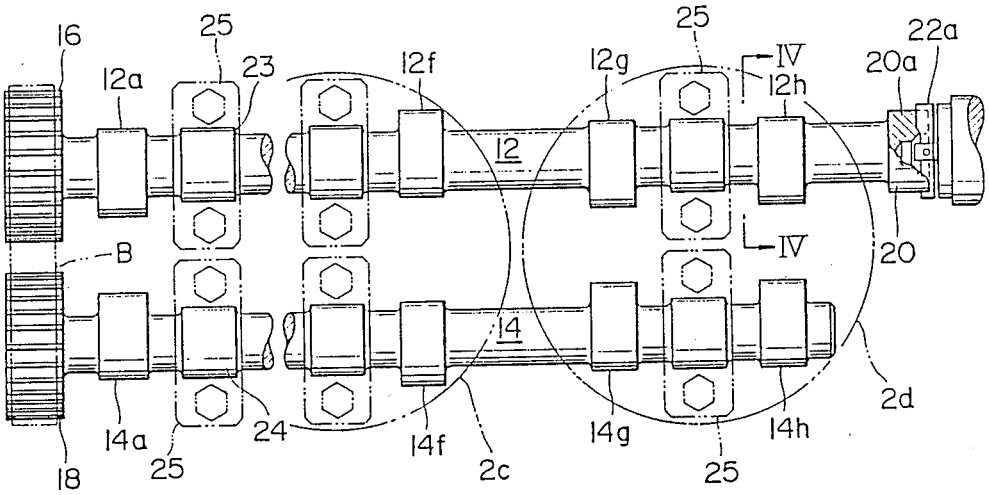
FIG. 3 is a top plan view of camshafts of the valve operating apparatus of FIGS. 1 and 2 with parts broken away for simplicity.

As is shown in more detail in FIG. 3, each camshaft 12, 14 has journals 23, 24 machined as a part thereof one located over every cylinder and between the adjacent two cams for the cylinder. At these journals 23, 24 each camshaft 12, 14 is mounted on the cylinder head CH by means of journal bearings 25 for rotation. It is to be noted that, because of the connecting end 20 of the intake camshaft 12 overhanging rearwardly outside the cylinder head CH and, thereby, supported in the form of a cantilever by the rearmost journal bearing 25, if all the intake cams 12*a* to 12 *h* have same cam lobes, the outermost intake valve 4*h* will cause a bouncing owing to the fact that the connecting end 20 of the intake camshaft 12 is generally susceptible to a rotating mass of the rotating shaft 22 of the distributor 21 and, thereby, tends resiliently to deflect. In addition, if the joint plate 22*a* pivoted by the drive shaft 22 of the distributor 21 is rigidly received in the joint groove 20*a* of the intake camshaft 12, the drive shaft 22 of the distributor 21 serves like as supporting means for the connecting end 20 of the intake camshaft 12 to eliminate or control the resilient deflection of the connecting end 20. However, for an easy assembling of the distributor 21 to the engine E, it is required to provide a flexible joint between the connecting end 20 of the intake camshaft 12 and the drive shaft 22 of the distributor 21. For this requirement, the joint groove 20*a* is unavoidably made wider for allowing the joint plate 22*a* to be received therein with ease. As a result, it becomes hard to eliminate that the camshaft 12 at the connecting end 20 is susceptible to a rotating mass of the distributor 21.

Figure 4:
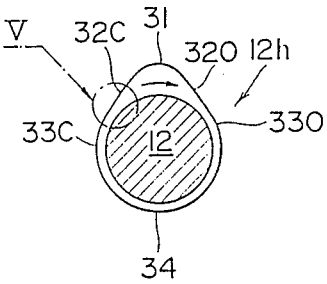
FIG. 4 is a side view, taken along a line IV—IV in FIG. 3, of an example of the outermost cam of the valve operating apparatus of FIGS. 1 to 3.
Figure 5A:
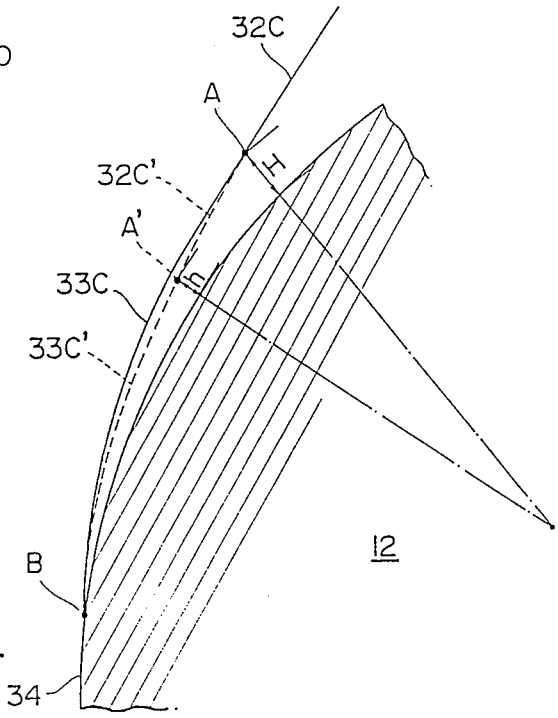
FIG. 5 (A) is an enlarged illustration showing a part of cam lobe of the cam of FIG. 4 encircled by a circle V.
Figure 5B:
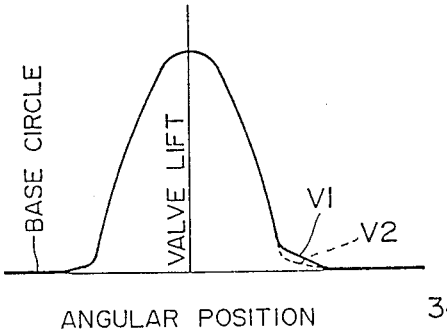

Reference is now had to FIGS. 4, 5(A) and 5(B) showing the outermost cam 12*h* of the intake camshaft 12 which is provided for the outermost intake valve 4*h* of the fourth cylinder 2*d*. The outermost cam 12*h*, which is machined as a part of the intake camshaft 12, has a cam lobe consisting of a cam nose section 31 by which the topmost position of travel of the valve is defined, opening and closing flank sections 320 and 32C continuously formed on opposite sides of the cam nose section 31 for lifting up and down the valve, and opening and closing lamp sections 33O and 33C which connect smoothly the opening and closing flank sections 320 and 32C to a base circle section 34 formed coaxially with the intake camshaft 12, respectively.

As is shown in FIG. 5(A), the cam lobe is partly depicted by a solid line for the outermost cam 12*h* and by a dotted line for the remaining cams 12*a* to 12*g* of the intake camshaft 12, only a difference between these cams being in ramp height. Each lamp height is, as is previously described, defined by the difference between a distance of the juncture point of the ramp section and the flank section from the center of the intake camshaft and a radius of the base circle section of the cam. Specifically, the cam lobe of the outermost cam 12 has a ramp height H which is defined by the difference between a distance of the juncture point A of the ramp section 33C and the closing flank section 32C from the center of the intake camshaft 12 and the radius of the base circle section 34, designed to be higher than a ramp height h, which is also defined by the difference between a distance of the juncture point A' of the closing ramp section 33C' and the closing flank section 32C' from the center of the intake camshaft 12 and the radius of the base circle section 34 of the cam lobe of the remaining cams 12*a* to 12*g* or 14*a* to 14*h* and, therefore, has a longer closing ramp section 33C than the closing lamp section 33C'. However, all the cams 12*a* to 12*h* have an opening ramp height which is the same as the closing ramp height h of the cam lobe of the outermost cam 12*h*. The difference in ramp height between the cam lobes of the outermost cam 12*a* and the remaining cams 12*a* through 12*g* gradually decreases from the juncture point A or A' to the base circle section 34 and terminates at a juncture point B on the base circle section 34.

As is shown in FIG. 5(B), the cam lobes of the cam 12*h* and the remaining cams 12*a* to 12*g* are designed to allow the intake valve 4*h*, and intake valves 4*a* to 4*g* to travel along valve lift curves V1 and V2, respectively, for one complete revolution of each camshaft, so as to open and close the intake valves 4*a* to 4*h*.

On the exhaust camshaft 14 also the outermost cam 14*h* is supported in the form of a cantilever by the outermost journal bearing 25. This outermost cam 14*h* may have a cam lobe with a ramp height either larger than or the same as those of the remaining cams 14*a* to 14*g*. The remaining cams 14*a* to 14*g* of the exhaust camshaft 14 have the same cam lobe as of the remaning cams 12*a* to 12*g* of the intake camshaft 12. If the exhaust camshaft 14 has its end portion extending more longer from the outermost bearing and is apt resiliently to deflect, it is preferred for the outermost camshaft 14*h* to have a ramp height larger than that of the remaining cams 14*a* to 14*g*.

In operating the valves by the valve operating apparatus according to the present invention constructed as above, when cranking the engine E by the aid of the starter, the starter motor 30 is actuated to turn the ring gear 29 machined as a part of the flywheel 28 of the crankshaft 10 through the geared shaft 30A, turning, in synchronism with the crankshaft 10, the intake and exhaust camshafts 12 and 14 at one half crankshaft speed through the timing gears 11, 16 and 18 operationally coupled by the timing belt B. Due to the turns of the intake camshaft 12, the distributor is operated so as to make and break the ignition primary circuit and to distribute resultant high voltage to the proper cylinder at correct timing.

When the engine is cranked, the crankshaft 10 pulls up or down the pistons 2. As the piston 2 is pulled down by the crankshaft 10, the intake camshaft 12 opens the intake valves, for example the intake valves 4*a* and 4*b* and the air-fuel mixture is drawn into the cylinder 2*a*. When the piston 2 reaches the bottom of its stroke, the camshaft 12 allows the intake valve 4*a* and 4*b* to close, and the crankshaft 10 forces the piston 2 up through the cylinder 2*a*. This compresses the airfuel mixture in the combustion chamber.

As the piston 2 nears the top of the compression stroke, the air-fuel mixture is ignitted by a spark in a well known manner. This explodes the mixture, and the pressure of the rapidly expanding gas drives the piston 2 down through the cylinder 2*a*. The intake and exhaust camshafts 12 and 14 maintain both the intake and exhaust valves 4*a*, 4*b*, 6*a* and 6*b* closed during this firing stroke.

After reaching the bottom of the firing stroke, the exhaust camshaft 14 opens the exhaust valves 6*a* and 6*b*, while the intake camshaft 12 maintains the intake valves 2*a* and 2*b*, and the spinning crankshaft 10 forces the piston 2 up through the cylinder 2*a*. This time all the burned gases are driven or exhausted from the cylinder 2*a* and the combustion chamber.

When the piston 2 reaches the top of the exhaust stroke, the exhaust camshaft 14 allows the exhaust valves 4*a* and 4*b* to close and, on the other hand, the intake camshaft 12 opens the intake valves 12*a* and 12*b*. The piston is drawn down on another intake stroke.

Once the cylinder 2 has fired, the heavy flywheel 28 will keep the crankshaft 10 spinning long enough to go through the exhaust, intake and compression strokes. The flywheel 28 then receives power from another firing stroke. This cycle is repeated over and over, and thus the engine will run on its own power. The above-described strokes take place on the other cylinders 2*b*, 2*c* and 2*d* at the predetermined proper timing.

As the crankshaft 10 continues to turn, it pushes the piston 2 up on compression, down on firing, and again up on exhaust. During these three strokes, the cam lobe of each intake cam 12*a* to 12*h* continues to turn. When the piston 2 reaches a top dead center (TDC) on the exhaust stroke, the closing flank section 32C, 32C' of the cam lobe of each intake cam is again touching the valve end member 8 of each valve.

Figure 6:
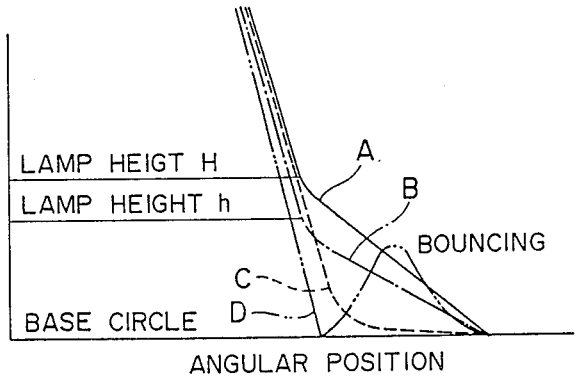
FIG. 6 is a diagram showing partly in detail valve lift curves.

While the camshaft 12 continues to turn, the rear end portion of the intake camshaft 12 is subjected to a great rotational mass from the distributor 21 and, thereby, tends resiliently to deflect. Because, in addition to a resilient deflection of the intake crankshaft 12, in the valve train including the wave end member 8 and the valve stem 7 occurs a thermal contraction, if the outermost cam 12*h* of the intake camshaft 12 has the same cam lobe with the ramp height h as those of the remaining cams 12*a* through 12*g* of which the valve motion is partly shown by a valve lift curve B in FIG. 6, the intake valve 4*h* will make a bouncing upon closing as is partly shown by a valve lift curve D while the intake valves 4*a* through 4*g* close smoothly without any bouncing. However, as is previously described, because the outermost cam 12*h* is designed and shaped to have the cam lobe with the higher ramp height H (of which the designed valve travel is partly shown by a valve lift curve A ), the intake valve 4*h* is actually allowed to take a smooth closing motion as shown by a valve lift curve C in FIG. 6. the intake valve 4*h* takes an actual motion shown by a valve lift curve C, closing smoothly without bounce.

Figure 7:
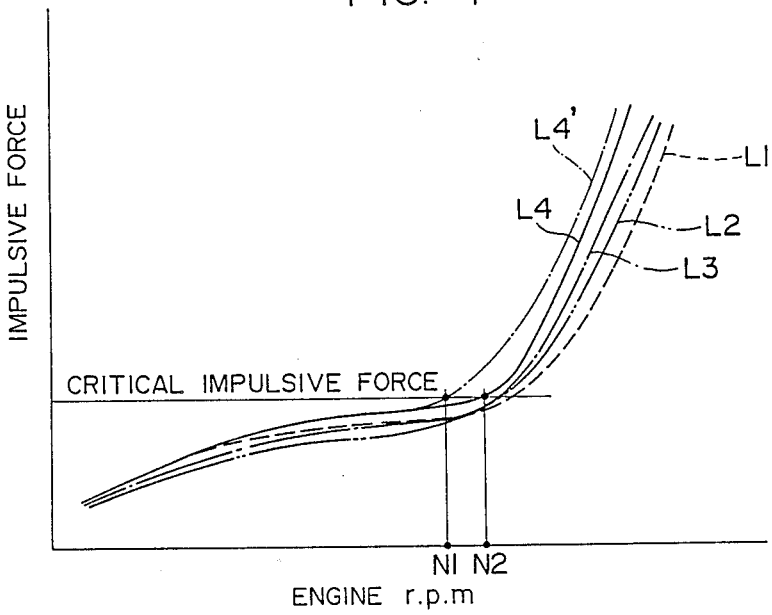
FIG. 7 is a graph showing the relationship between an impulsive force exerted on valve and engine r.p.m.

As is shown by a graph in FIG. 7, an impulsive force that an intake valve exerts on its associated valve seat increasingly changes as an increase of engine speed. Curves L1, L2, L3 and L4 show impulsive forces exerted on valve seats by the intake valves 4*a* to 4*g* of the cylinders 2*a*, 2*b*, 2*c* and 2*d*, respectively and a curve L4' is an impulsive force which will be exerted on the valve seat for the intake valve 4*h* in the case that the cam 12*h* is assumed to have the same ramp height of cam lobe as those of the cams 12*a* through 12*g*. In FIG. 7, NI represents a critical impact force at which an undesirable bouncing of valve occurs and, therefore, by which a maximum engine speed (r.p.m.) is practically governed. As is apparent from the graphs, the practical maximum engine speed (r.p.m.). at which the engine can be operated is increased to N2 from N1.

According to some practical experience a difference of ramp height of approximately 0.1 to 0.2 mm between the outermost cam 12*h* and the remaining cams 12*a* to 12*g*, the engine speed at which the valve 4*h* in association with the outermost cam 12*h* of the intake camshaft 12 makes an undesirable bouncing can be practically increased by about 300 r.p.m. that is, from the engine speed N1 to N2.

Figure 8:
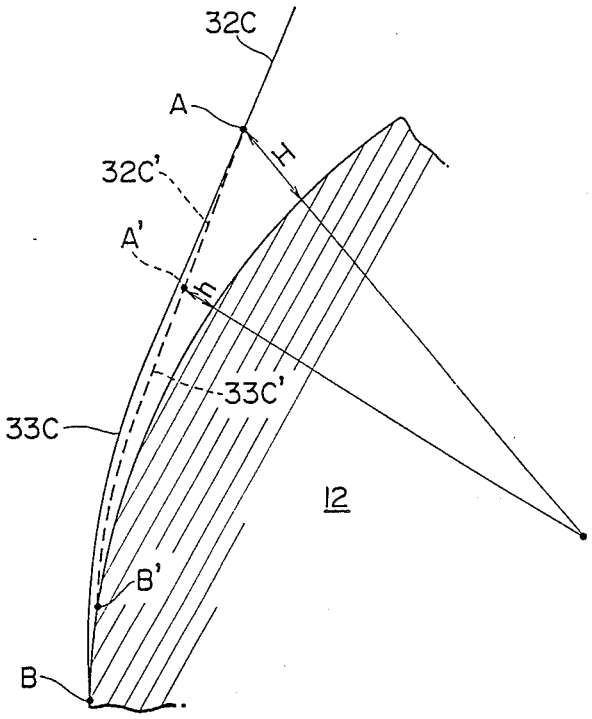
FIG. 8 is an illustration similar to that of FIG. 5(A) and showing another example of a part of cam lobe of the outermost cam.
Figure 8A:
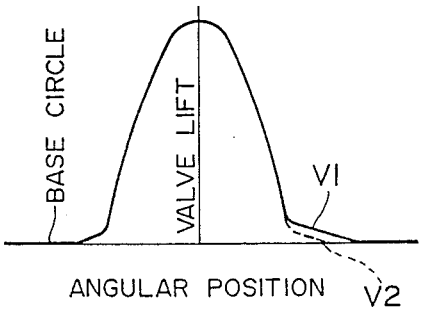
FIG. 8(A) is a diagram similar to that of FIG. 5(B) and showing a valve lift curve of the outermost cam of FIG. 8.

FIGS. 8 and 8(A) show a part of the cam lobe of the cam 12*h* of another example of the cam 12*h*. The cam lobe of the cam 12*h* has the same ramp height H as that in the previous embodiment. However, substantially a same difference in lamp height, namely a difference H−h, is provided between the cam lobes of the cam 12*h* and the remaining cams 12*a* to 12*g* over the closing ramp section 33C. In other words, the lamp section 33C of the cam lobe of the cam 12*h* is in parallel with the ramp section 33C' of the cam lobe of the remaining cams 12*a* to 12*g* and, therefore, the ramp section 33C of the cam lobe of the cam 12*h* terminates at a point B on the base section 34 different from a point B' at which the ramp section 33C' of the cam lobe of the remaining cams terminates on the base section 34.

Figure 9:
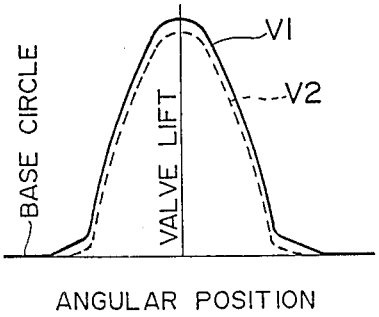
Fig. 9 is a diagram similar to that of FIGS. 5(B) and (A) and showing a valve lift curve of a still another embodiment of cam lobe of the outermost cam.

Alternatively, as is shown in FIG. 9, the cam 12*h* can be formed to have a cam lobe which has a ramp height higher than that of the remaining cams 12*a* to 12*g* on the opening and closing ramp sections and a cam profile analogous or similar to that of the remaining cams 12*a* to 12*g* and producing greater valve lift.

Figure 10:
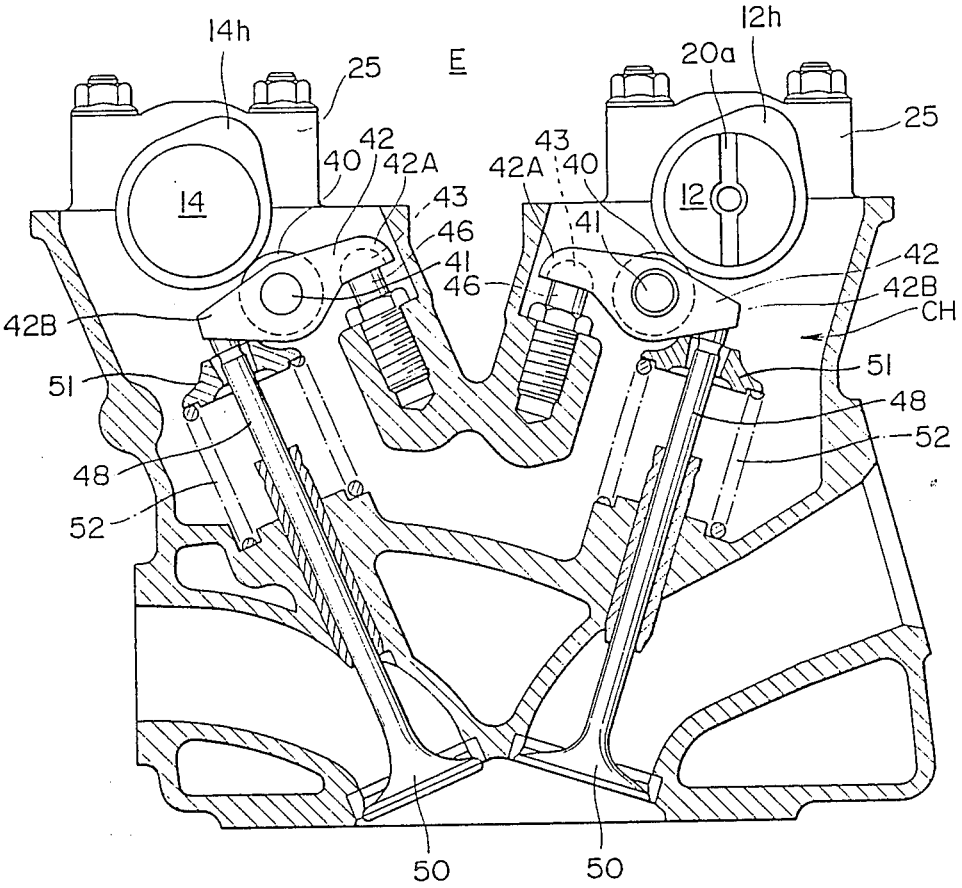
Fig. 10 is a schematic cross sectional view of an internal combustion engine of the type having a rocker arms, with its cylinder block is omitted, which embodies the present invention.

Although the present invention is described by way of an example in which each cam operates directly the valve end member 8, it can be applicable to a valve operating apparatus of the type having a rocker arm of which one end is pivoted. Referring, to FIG. 10 shown therein is the engine E which mounts the intake and exhaust camshafts 12 and 14. The intake and exhaust camshafts 12 and 14, which are just the same in construction and function as these used in the previous embodiment shown in FIGS. 1 through 3 and mounted on the engine E by the journal bearings 25 in the same way as described as to the previous embodiment and so, no detailed description is needed. Each outermost cam 12*h*, 14*h* has the same cam lobe as any one of the cam lobes described and shown in FIGS. 5(B), 8(A) and 9 and is in contact with a cam follower 40 rotatably mounted on a rocker shaft 41 of a rocker arm 42. The outermost cam 12*h*, 14*h* is supported in the form of a cantilever by the outermost bearing 25. Formed at the end of the intake camshaft 12 is the joint groove 20*a* for receiving therein the joint plate 22*a* mounted on the drive shaft 22 of the distributor 21 shown in FIGS. 1 and 3.

One end 42A of the rocker arm 42 is formed with a hemispherical recess 43 in which received is a rounded top end of a rocker arm pivot 46 fixed to the cylinder head CH. The opposite end 42B of the rocker arm 42 is in contact with the top end of a valve stem 48 of a valve 50 forced upwardly by means of a valve spring 52 disposed between the cylinder head CH and a spring retainer 51 at the top of the valve stem 48. Due to this pivoted and spring forced rocker arm 42, the cam follower 40 always presses against the cam 12*h*, 14*h*. Therefore, when the camshaft 12, 14 turns, the rocker arm 42 is swung about the rounded top end of the fixed rocker pivot arm 46 as a fulcrum following the cam lobe of the cam 12*h*, 14*h*.

The valve stem 48 slides up and down in a hole bored in the cylinder head CH to open and close the valve 50 when the camshaft 12, 14 turns. It is apparent that the engine shown in FIG. 10 is the same in construction and operation as the engine shown in FIG. 1 expcepting the provision of the rocker arm 42 between the cam and the valve stem.

In the valve operating apparatus of the present invention applied to the engine of the type having the valve operating apparatus including the rocker arm shown in FIG. 10, although, in addition to a thermal deflection of the valve train, the end portion of the camshaft, in particular the intake camshaft 12 tends to deflect, the valve 50 can close without any bouncing because of provision of the outermost cam 12*h* having a cam lobe with a ramp height H higher than that of the remaining cams 12*a* to 12*g*. As a result, the engine of this type can also increase its practical maximum engine speed.

Although the present invention has been fully described by way of the preferred embodiments thereof with reference to the accompanying drawings, it is to be noted that various changes and modifications are apparent to those skilled in the art. Therefore, unless otherwise such changes and modifications depart from the true scope of the present invention, they should be construed as included therein.

What is claimed is:

1. An engine valve operating apparatus for a multi-cylinder internal combustion engine comprising a camshaft having a plurality of cams each of which has a cam lobe consisting of a cam nose section, opening and closing flank sections disposed on opposite sides of said cam nose section for opening and closing an engine valve associated with each said cam, and ramp sections connecting said opening and closing flank sections to a base section of said cam, respectively; and a plurality of journals formed between said plurality of cams through which said camshaft is mounted on said engine for rotation, said plurality of cams including an outermost cam which is located outside an outermost journal of said plurality of journals and has a closing ramp height higher than any opening and closing ramp height of any one of the remaining cams.

2. An engine valve operating apparatus as defined in claim 1, wherein said camshaft has a plurality of cams for every cylinder of said engine and a plurality of journals one between every two said cams.

3. An engine valve operating apparatus as defined in claim 2, wherein said camshaft has at one end a timing means for rotatably coupling to a crankshaft of said engine and at the other end a coupling means for removably coupling a distributor of said engine disposed coaxially with said camshaft.

4. An engine valve operating apparatus as defined in claim 3, including bearing means for mounting said camshaft overhead a cylinder head of said engine.

5. An engine valve operating apparatus as defined in claim 2, wherein said remaining cams have the same cam lobes with the same opening and closing ramp heights.

6. An engine valve operating apparatus as defined in claim 5, wherein said outermost cam has a cam lobe with the same opening ramp height as those of said remaining cams.

7. An engine valve operating apparatus as defined in claim 6, wherein said closing ramp sections of all said plurality of cams terminate at the same points on said base sections.

8. An engine valve operating apparatus as defined in claim 6, wherein said closing ramp section of said outermost cam is substantially in parallel with said closing ramp sections of said remaining cams.

9. An engine valve operating apparatus as defined in claim 8, wherein said outermost cam has a cam lobe similar to those of said remaining cams.

10. A valve operating apparatus for operating intake an exhaust valves of a multi-cylinder internal combustion engine, said apparatus comprising:

an intake camshaft having a respective cam for opening and closing each of two intake valves incorporated in each said cylinder;

a plurality of bearing means for mounting said intake camshaft on said engine for rotation, each by bearing means disposed between said two cams individual to each cylinder;

an exhaust camshaft having a respective cam for opening and closing each of two exhaust valves incorporated in said each cylinder;

said exhaust bearing means for mounting said exhaust camshaft on said engine for rotation;

timing means mounted on one end of each of said intake and exhaust camshafts for rotatably coupling said intake and exhaust camshafts to a crankshaft of said engine by means of a timing belt;

each cam of said plurity of cams of said intake and exhaust camshafts being coupled with one of said intake and exhaust valves and having a cam lobe comprising a cam nose section, opening and closing flank sections disposed on opposite sides of said cam nose section for opening and closing said valve to which the cam is coupled, and ramp sections conecting said opening and closing flank sections to a base section of said cam, and said plurality of cams of at least one camshaft of said intake and exhaust camshafts including an outermost cam cantilever supported by an outermost one of said plurality of bearing means and disposed on the opposite end of said one camshaft from said timing means, said outermost cam having a cam lobe with a closing ramp height higher than that of the cam lobes of the remaining cams of said one camshaft.

11. A valve operating apparatus as defined in claim 10, including means on said opposite end of said one camshaft for removably coupling a distributor of said engine disposed coaxially with said one camshaft.

12. A valve opening apparatus as defined in claim 10, including means for mounting said intake and exhaust camshafts overhead of said engine.

13. A valve operating apparatus as defined in claim 10, wherein said one camshaft is said intake camshaft.

14. A valve operating apparatus as defined in claim 13, wherein said intake camshaft is axially longer than said exhaust camshaft.

15. A valve operating apparatus for operating intake and exhaust valves of a multi-cylinder internal combustion engine, said apparatus comprising:

an intake camshaft having a respective cam for opening and closing each of two intake valves incorporated in each said cylinder;

a plurality of bearing means for mounting said intake camshaft on said engine for rotation with each bearing means disposed between each said two cams;

an exhaust camshaft having a respective cam for opening and closing each of two exhaust valves incorporated in each said cylinder;

bearing means for mounting said exhaust camshaft on said engine for rotation;

timing means mounted on one end of each of said intake and exhaust camshafts for rotatably coupling said intake and exhaust camshaft to a crankshaft of said engine by means of a timing belt;

a rocker arm cooperating with each cam of said plurality of cams of said intake and exhaust camshafts for operating its associated valve;

each cam having a cam lobe including a cam nose section, opening and closing flank sections disposed on opposite sides of said cam nose section for opening and closing said each valve, and ramp sections connecting said opening and closing flank sections to a base section of each said cam; and said plurality of cams of at least one camshaft of said intake and exhaust camshafts including an outermost cam cantilever supported by outermost one of said plurality of bearing means and disposed on the opposite end of said one camshaft from said timing means, said outermost cam having a cam lobe with a closing ramp height higher than that of the cam lobes of the remaining cams of said one camshaft.

16. A valve operating apparatus as defined in claim 15, including means on said opposite end of said one camshaft for removably coupling a distributor of said engine disposed coaxially with said one camshaft.

17. A valve operating apparatus as defined in claim 15, including means for disposing said intake and exhaust camshafts overhead a cylinder head of said engine.

18. A valve operating apparatus as defined in claim 15, wherein said one camshaft is said intake camshaft.

19. A valve operating apparatus as defined in claim 18, wherein said intake camshaft is axially longer than said exhaust camshaft.

* * * * *